United States Patent [19]

Dockery

[11] 4,023,701

[45] May 17, 1977

[54] BREATHING APPARATUS FOR UNDERWATER USE

[76] Inventor: Denzel J. Dockery, G-4142 Fenton Road, Flint, Mich.

[22] Filed: Nov. 24, 1975

[21] Appl. No.: 634,618

Related U.S. Application Data

[63] Continuation-in-part of Ser. No. 447,477, March 4, 1974, abandoned.

[52] U.S. Cl. ..... 220/64; 73/395; 206/.7

[51] Int. Cl.[2] ..... B65D 25/14

[58] Field of Search ..... 141/325, 326, 327, 2, 141/3, 20, 113; 206/.7; 220/63 R, 64, 3, 85 B; 73/389, 392, 395; 222/183, 3, 105, 189, 92–95, 107, 386

[56] References Cited

UNITED STATES PATENTS

| | | | |
|---|---|---|---|
| 1,675,083 | 6/1928 | Avery | 206/.7 |
| 2,261,027 | 10/1941 | Hopkins | 73/39 S |
| 2,987,216 | 6/1961 | Fletcher | 220/63 R |
| 3,422,679 | 1/1969 | McGowan et al. | 73/395 |

*Primary Examiner*—Houston S. Bell, Jr.
*Attorney, Agent, or Firm*—Gifford, Chandler, Sheridan & Sprinkle

[57] ABSTRACT

A receptacle containing gas and water adsorbent material for storing a pressurized breathable gaseous mixture for underwater use. The receptacle includes an auxiliary access plug for inserting the gas adsorbent material into the receptacle so that the material may be tightly packed within the receptacle and a screen to separate the gas adsorbent material from a conventional pressure reducing means.

5 Claims, 3 Drawing Figures

BREATHING APPARATUS FOR UNDERWATER USE

CROSS-REFERENCE

The present invention is a continuation-in-part of patent application Ser. No. 447,477 filed Mar. 4, 1974 and now abandoned.

BACKGROUND OF THE INVENTION

I. Field of the Invention

The present invention relates to a receptacle for storing a pressurized gas and more particularly to a breathing apparatus for underwater use and containing a gas adsorbent material.

II. Description of the Prior Art

Receptacles for pressurized gas containing gas adsorbent material, such as activated charcoal, therein have been disclosed in the prior art, such as in U.S. Pat. Nos. 1,608,155 and 3,604,416. A receptacle filled with gas adsorbent material is capable of storing a much greater amount of gas at the same pressure and temperature than the conventional hollow receptacle, therefore increasing the gas storage capacity and efficiency of the receptacle.

Heretofore known pressurized gas receptacles for underwater use, or, as they are commonly called scuba diving tanks, typically comprises a hollow cylindrical tank with a single upper aperture upon which a pressure reducing means is affixed Many difficulties have been encountered with the previously known scuba tanks. For example, the natural buoyancy of the scuba tank requires divers to use heavy weights tied around their ankles, wrists, and/or waist in order to submerge. In addition, because pressurized gas is a poor conductor of heat, great care must be taken not to allow the gases to overheat, particularly while filling the tank with pressurized gas. Lastly, the internal protective coating of the previously known scuba tanks has been known to peel or "rip-off" during a rapid decompression of the tank. Applicant has found that using a gas adsorbent material such as charcoal diminishes the chance of overheating because the charcoal reduces velocity of the molecules striking the sides of the tank, Applicant has therefore found that a scuba tank filled with gas adsorbent material, such as charcoal, will overcome many of the above mentioned disadvantages of previous tanks.

Other difficulties, however, have been encountered by Applicant when attempting to fill scuba tanks with gas adsorbent material. It has been found that, if the gas adsorbent material is loosely packed within the tank, dust particles float around within the tank and clog the conventional pressure regulating means between the scuba tank and the diver's breathing hoses which, needless to say, is a dangerous condition for a submerged diver. Floating dust particles of the adsorbent material within the tank present even a more serious problem since such particles may spontaneously ignite and explode.

Thus, to tightly compact adsorbent material within a conventional scuba tank is not practical, primarily because the conventional tank has only a single access hole through which the pressure regulating means must also be inserted. It becomes virtually impossible to achieve a tightly packed gas adsorbent material composition inside the tank with the single access hole arrangement known in the prior art.

SUMMARY OF THE PRESENT INVENTION

The pressurized gas receptacle of the present invention overcomes the above mentioned disadvantages of the prior art by providing a receptacle or scuba tank with a second access hole, preferably located on the bottom of the tank. After the conventional pressure regulating means are attached to the top access hole of the tank, gas adsorbent material, such as activated charcoal is packed into the tank through the second access hole. A porous or fine mesh filter is disposed around the pressure regulating means inside the tank to prevent the gas adsorbent material from passing up into the pressure regulating means and to prevent the inhalation of the adsorbent material by the diver.

It, therefore, becomes a principal object of the present invention to provide a scuba diving tank filled with a gas adsorbent material that can be easily and inexpensively constructed.

It is a further objection of the present invention to provide a scuba tank filled with gas adsorbent material in which the adsorbent material may be tightly packed within the tank so that the protective lining around the tank will not peel off during a rapid decompression.

A still further object of the present invention is to provide a scuba tank filled with a water adsorbent material to reduce corrosion to the tank and the associated pressure regulating means. Furthermore, the adsorbent material enjoys a greater heat transfer properties than oxygen thereby preventing the gases from overheating within the tank.

BRIEF DESCRIPTION OF THE DRAWING

Still further objects and advantages of the present invention will become apparent to those skilled in the art to which the invention pertains upon reference to the detailed description when read in conjuction with the following drawing wherein like reference characters refer to like parts throughout the several views, and in which.

DETAILED DESCRIPTION

Figure 1:
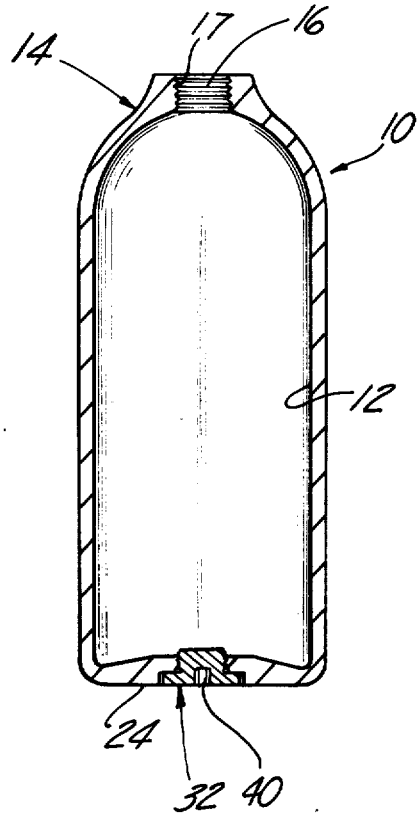
FIG. 1 is a cross-sectional view of the pressurized gas receptacle of the present invention with portions removed for clarity.

The gas storage receptacle or scuba tank of the present invention is shown in FIG. 1 as a hollow and generally cylindrical metallic container 10. The inner surface of container 10 is preferably coated with a rust resistant material thereby forming a liner 12 as is conventional to prevent any accumulated moisture within the container 10 from corroding the inner walls of the container 10.

Figure 2:
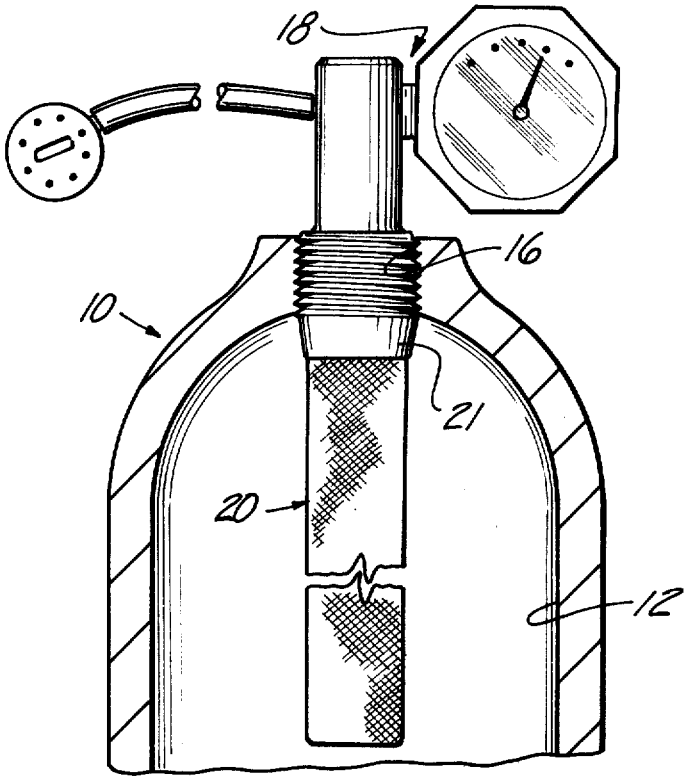
FIG. 2 is a fragmentary cross-sectional view of the top portion of the gas storage receptacle of the present invention.

The upper portion 14 of the container 10 preferably has an aperture 16 with threads 17 adapted to receive a conventional pressure regulating or pressure reducing means 18 for pressurized containers, as shown in FIG. 2. Alternately, the pressure regulating means 18 may be press fitted or secured in any conventional manner to the aperture 16.

As can best be seen in FIG. 2, a generally elongated and cylindrical rigid filter 20 is attached to and forms part of the pressure reducing means 18. The filter 20, disposed directly underneath the air regulating means 18 inside the container 10, is removed from the container 18 in unison with the means 18. The filter 20 is preferably attached to a downwardly extending annular flange 21 on the pressure regulating means 18 by any conventional attachment means (not shown), such as press-fitting and the like, so that the entire gas flow between the interior of the container 10 and the pressure regulating means 18 passes through the filter 20. The function of the filter 20 will be subsequently described.

Figure 3:
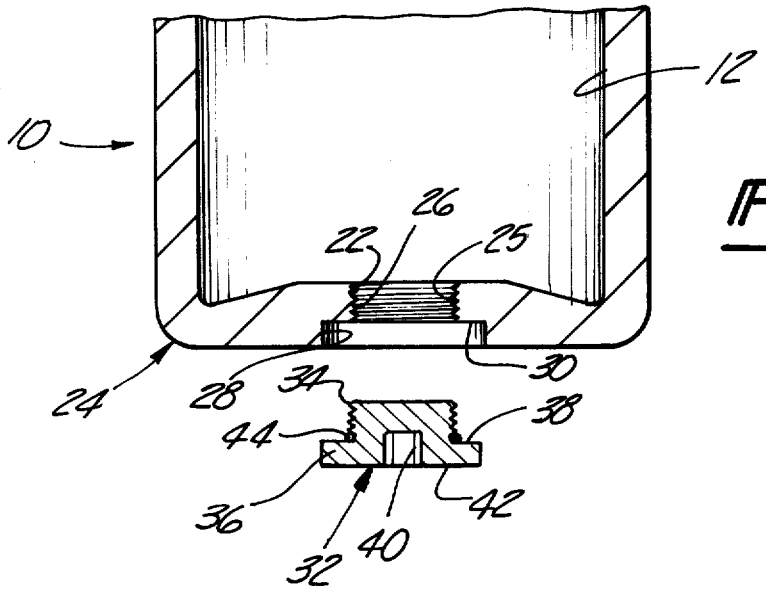
FIG. 3 is an exploded fragmentary cross-sectional view of the bottom portion of the gas storage receptacle of the present invention.

As can best be seen in FIG. 3, a second circular aperture 22 is preferably provided through the bottom end 24 of the container 10, although, alternately, the aperture 22 may be elsewhere positioned, such as through the side of the container. The aperture 22 has an inner small diameter portion 25 with threads 26 and an outer non-threaded and enlarged diameter portion 28 which with the inner threaded portion 25 forms an annular abutment surface 30.

A plug 32, having a threaded portion 34 adapted to mate with the threads 26 in the inner portion 25 of the apperture 22 and an enlarged head portion 36, forms a second abutment surface 38 with the smaller diameter threaded portion 34. The head portion 36 of the plug 32 is slightly less in diameter than the enlarged diameter portion 28 of the aperture 22 so that the plug head 36 may fit into the recess formed by the enlarged diameter portion 28 of the aperture 22 (FIG. 1). Preferably, a hexagonal recess 40 is formed along the longitudinal axis of the plug 32 on the outer surface 42 of the plug so that an Allen wrench may be used to turn and tighten the plug 32 in the aperture 22. Alternately, a screwdriver slot or the like may be formed on the outer surface 42 of the plug 32 for a like purpose.

In operation, the pressure regulating means 18 along with the filter element 20 is screwed into the first aperture 16 in the conventional manner so that the filter element 20 is disposed inside and substantially in axial alignment with the container 10. Conventional and well known sealing means (not shown) are included in the aperture 22 to provide an air-tight engagement between the container 10 and the pressure regulating means 18.

With the plug 32 removed from the bottom aperture 22, the container 10 is filled with a gas and water adsorbent material, such as activated charcoal, silica gel, magnesium silicate, activated aluminia, and the like, through the bottom aperture 22. The bottom aperture 22 thus provides an easy and efficient means for packing the gas adsorbent material within the container 10, thereby eliminating the possibility of spontaneous combustion from the dust particles of a loosely packed adsorbent material as has been heretofore known in the prior art. The plug 32 is then tightened into the aperture 22 by an Allen wrench or the like until the annular surfaces 30 and 38 abut against each other. Preferably, an O-ring 44 is disposed around the plug 32 to provide an air-tight seal between the plug 32 and the container 10, although other sealing means such as, for example, a resilient washer disposed between the annular abutment surfaces 30 and 38 may be used.

The mesh or pore size of the filter 20 is substantially smaller than the diameter of the granular adsorbent material in order to prevent the adsorbent material from passing up into the pressure regulating apparatus 18 of the scuba tank. Although the mesh size of the filter 20 must be quite small, the flow restriction through the filter 20 is not prohibitive due to the high gas pressures within the container 10.

With the scuba tank of the present invention filled with gas adsorbent material as hereinabove described, many advantages are realized over previously known diving tanks. The gas adsorbent material permits a much greater amount of gas to be stored within the tank than known in the prior art, thus creating a longer period in which the diver may remain submerged. Furthermore, the comparatively heavy gas adsorbent material reduces the buoyancy of the scuba tank, thus eliminating the necessity for heavy and uncomfortable weights normally worn around the diver's wrists, ankles, and/or waist.

The tightly packed gas adsorbent material also serves many other purposes and provides many advantages over the prior art scuba diving tanks. The gas adsorbent material also absorbs moisture in the scuba tank, thereby reducing corrosion to the scuba tank and the breathing apparatus. The material also conducts internal heat as occurs, e.g. when air is compressed into the scuba tank during refilling, much more rapidly to the cylindrical walls of the scuba tank than the oxygen in the previously known scuba diving tanks. Furthermore, the gas adsorbent material tends to hold the protective inner lining 12 of the scuba tank against the sides of the tank during a rapid decompression of the tank, whereas in prior art tanks, the inner protective lining is often pulled or "ripped off" the tank during a rapid decompression.

It is apparent that the scuba diving tank of the present invention overcomes many disadvantages known to the prior art scuba diving tanks. It is also obvious that many changes and modifications may be made to the above described scuba tank and method for making the same without departing from the spirit of the invention or the scope of the appended claims.

What is claimed is:

1. A tank for underwater use of the type adapted to be pressurized with a breathable gas and depressurized underwater to provide the gas to a user, said tank comprising:

a container defining a chamber and having a first and second aperture communicating with said chamber;

a pressure regulating means removably secured to said container and having a portion extending axially into said first aperture, said pressure regulating means further comprising a filter secured to said portion and extending axially into said chamber whereby said filter is removed from said chamber through said first aperture upon the removal of said pressure regulating means;

a liner coated onto the surface of said chamber to protect said tank from corrosion whereby-the liner adheres to the surface of the chamber;

said chamber being completely filled with a gas and liquid adsorbent material insertable into said container through said second aperture whereby said material both adsorbs corrosive liquids from said chamber and permits the storage of a greater amount of gas within the chamber than without the material, wherein said material is firmly packed into said chamber to prevent floating dust particles of said material whereby said material holds said liner onto the surface of the chamber upon a rapid decompression of the tank, and wherein said material has greater heat transfer properties than the gas so that said material transfers heat to said tank upon rapid compression of said tank; and means for sealing said second aperture.

2. The container as defined in claim 1, wherein said first and second apertures are at opposite ends of said container.

3. The container as defined in claim 1, in which said sealing means comprises a threaded plug.

4. The container as defined in claim 1, in which said filter means is elongated and cylindrical in shape.

5. The container as defined in claim 1, wherein said gas adsorbent material is granular in form.

* * * * *